US005356344A

United States Patent [19]

Lemieux

[11] Patent Number: 5,356,344

[45] Date of Patent: Oct. 18, 1994

[54] SYNTHETIC TURF, METHOD OF MAKING THEREOF, BORDER STRIP FOR SMALL SIZE GOLF AND UNDERSTRUCTURE FOR ARTIFICIAL LARGE SIZE GOLF

[75] Inventor: Alain Lemieux, Longueuil, Canada

[73] Assignee: Top Golf, Inc., Boucherville, Canada

[21] Appl. No.: 705,508

[22] Filed: May 24, 1991

[51] Int. Cl.[5] ..... A63B 71/02

[52] U.S. Cl. ..... 472/92; 428/17

[58] Field of Search ..... 472/92; 404/32; 428/17, 428/92, 97

[56] References Cited

U.S. PATENT DOCUMENTS

| | | | |
|---|---|---|---|
| 3,395,625 | 8/1968 | Blanchette et al. | 472/92 X |
| 3,418,897 | 12/1968 | Humalainen | 472/92 |
| 3,573,147 | 3/1971 | Elbert . | |
| 3,577,681 | 4/1971 | Waag . | |
| 3,597,297 | 8/1971 | Buchholtz et al. . | |
| 3,661,687 | 5/1972 | Spinney, Jr. et al. | 472/92 X |
| 3,735,988 | 5/1973 | Palmer et al. . | |
| 3,740,303 | 6/1973 | Alderson et al. . | |
| 3,801,421 | 4/1974 | Allen et al. . | |
| 3,995,079 | 11/1976 | Haas, Jr. . | |
| 4,044,179 | 8/1977 | Haas, Jr. | 472/92 X |
| 4,061,804 | 12/1977 | McCulloch . | |
| 4,356,220 | 10/1982 | Benedyk . | |
| 4,389,435 | 6/1983 | Haas, Jr. . | |
| 4,497,853 | 2/1985 | Tomarin . | |
| 4,902,540 | 2/1990 | Martino . | |
| 4,902,541 | 2/1990 | Martino . | |

FOREIGN PATENT DOCUMENTS 3129837 2/1983 Fed. Rep. of Germany ..... 472/92

*Primary Examiner*—Carl D. Friedman
*Assistant Examiner*—Kien Nguyen
*Attorney, Agent, or Firm*—Collard & Roe

[57] ABSTRACT

The synthetic turf has a base made of fabric material from which upwardly projects a mass of entangled, crimped grass-like frayed blades made of polypropylene, nylon or polyester. The blades have a length between ⅜" and 2", a weight from 28 to 60 ounces per square foot and a denier value of about 5400. The method of treating this synthetic turf consists in sandblasting the blades from above the turf at a distance of about 3 to 4 feet with a jet of sand having a pressure of about 80 to 120 pounds per square inch and directed at an angle of about 70° to 80° from the horizontal and in a circular motion. The border strip for an artificial golf practice course comprises a body made of polystyrene, a sheet of polypropylene applied over the body and a synthetic turf covering applied over the sheet of polypropylene. The body is shaped so that the synthetic turf covering form a ball rolling surface inclined or square with respect to a central playing surface. The understructure for an artificial golf course comprises a plurality of platform structures arranged side-by-side in the manner of a checkerboard, these structures establishing nodal points at the junctions of every group of four adjacent platform structures and a lifting jack at each of the nodal points. Bolts connect the corners of adjacent platform structures at each nodal point to a relevant one of the jacks.

5 Claims, 8 Drawing Sheets

SYNTHETIC TURF, METHOD OF MAKING THEREOF, BORDER STRIP FOR SMALL SIZE GOLF AND UNDERSTRUCTURE FOR ARTIFICIAL LARGE SIZE GOLF

BACKGROUND OF THE INVENTION

1. Field of the Invention

The present invention concerns tile game of golf, in general, and more particularly a synthetic turf having a simulated grass surface; a method of treating it; border strips for artificial minigolf, and an understructure for an artificial large size golf course.

2. Description of the Prior Art

Synthetic turfs are well known in the prior art, for example in U.S. Pat. Nos. 4,356,220; 4,389,435 and 4,497,853. They generally include a fabric base tufted with conventional artificial grass blades held to the fabric base by an adhesive material such as polyurethane which also provides a certain cushioning effect.

Also known in the prior art, more particularly in U.S. Pat. No. 3,735,988, is a practice putting surface making use of vertical border strips intended to prevent the golf ball from rolling off the putting surface.

Further patents found in a prior art search are as follows: U.S. Pat. Nos. 3,573,147; 3,577,681; 3,597,297; 3,740,303; 3,801,421; 3,995,079; 4,061,804; 4,902,540; and 4,902,541.

One drawback with the above-mentioned patents is that these artificial turfs do not provide a very good imitation of natural turf.

Also, none of the above-mentioned patents provides an adequate strip border for minigolf.

According to one aspect of the present invention, it is an object to propose an artificial turf providing a better imitation of a natural turf than the one known in the art.

According to another aspect of the present invention, it is an object to provide a strip border for minigolf that present interesting characteristics for golf players.

According to another aspect of the present invention, it is an object to provide an understructure for a large size golf surface, allowing modifications of the shape of the golf surface.

SUMMARY OF THE INVENTION

According to the present invention, there is provided a synthetic turf comprising:

a base made of fabric material;

a mass of entangled, crimped grass-like frayed blades made of a material selected from the group consisting of polypropylene, nylon and polyester; said blades being grouped into tufts projecting upwardly from said base; and a layer of adhesive material fixing lower ends of said tufts into said base, said blades have a length in the range of ⅜" to 2" and a weight in the range of 28 to 60 ounces per square foot.

Thus, a dense and uniform playing surface is obtained to allow a golf ball to hold on to its trajectory after being hit, much as on a natural golf course. The synthetic grass material, previously tinted green, also loses its luster during sandblasting and adapts a pale green close to that of natural grass.

According to the present invention, there is also provided a method of treating a grass-like blade surface of a synthetic turf, said method comprising steps of:

selecting a synthetic turf including blades made of a material chosen in the group consisting of polypropylene, nylon and polyester; said blades being grouped into tufts projecting upwardly from a fabric base; and sandblasting said blades from above said turf at a distance of about 3 to 4 feet with a jet of sand having a pressure of about 80 to 120 pounds per square inch directed at an angle of about 70° to 80° from the horizontal and in a circular motion.

According to the present invention, there is also provided a border strip for an artificial golf practice course, this border strip can be mounted to extend along edges of a playing surface, said border strip comprising a body made of polystyrene of type 2, a sheet of polypropylene laminated over said body, and a synthetic turf covering fixed over said sheet of polypropylene, said body being shaped so that said synthetic turf covering forms a ball rolling surface inclined or square with respect to said playing surface.

Known in the art are vertical border strips intended to prevent a golf ball from rolling off the putting surface.

These strips are made of hard material and have the effect, however, of producing big rebound of the ball. To eliminate this drawback, a border strip as described above is provided.

According to the present invention, there is also provided an understructure for an artificial game surface, comprising:

a plurality of platform structures arranged side-by-side, said platform structures establishing nodal points at junctions of every group of four adjacent platform structures;

a plurality of lifting jacks, each of said jacks being disposed at one of said nodal points; and a plurality of connecting means, each of said means connecting corners of the adjacent platform structures at one of said nodal points to the relevant one of said jacks, whereby said golf surface has a shape that can be modified by means of said lifting jack.

A description now follows of preferred embodiments of the invention having reference to the appended drawings.

DESCRIPTION OF THE PREFERRED EMBODIMENTS

Figure 1:
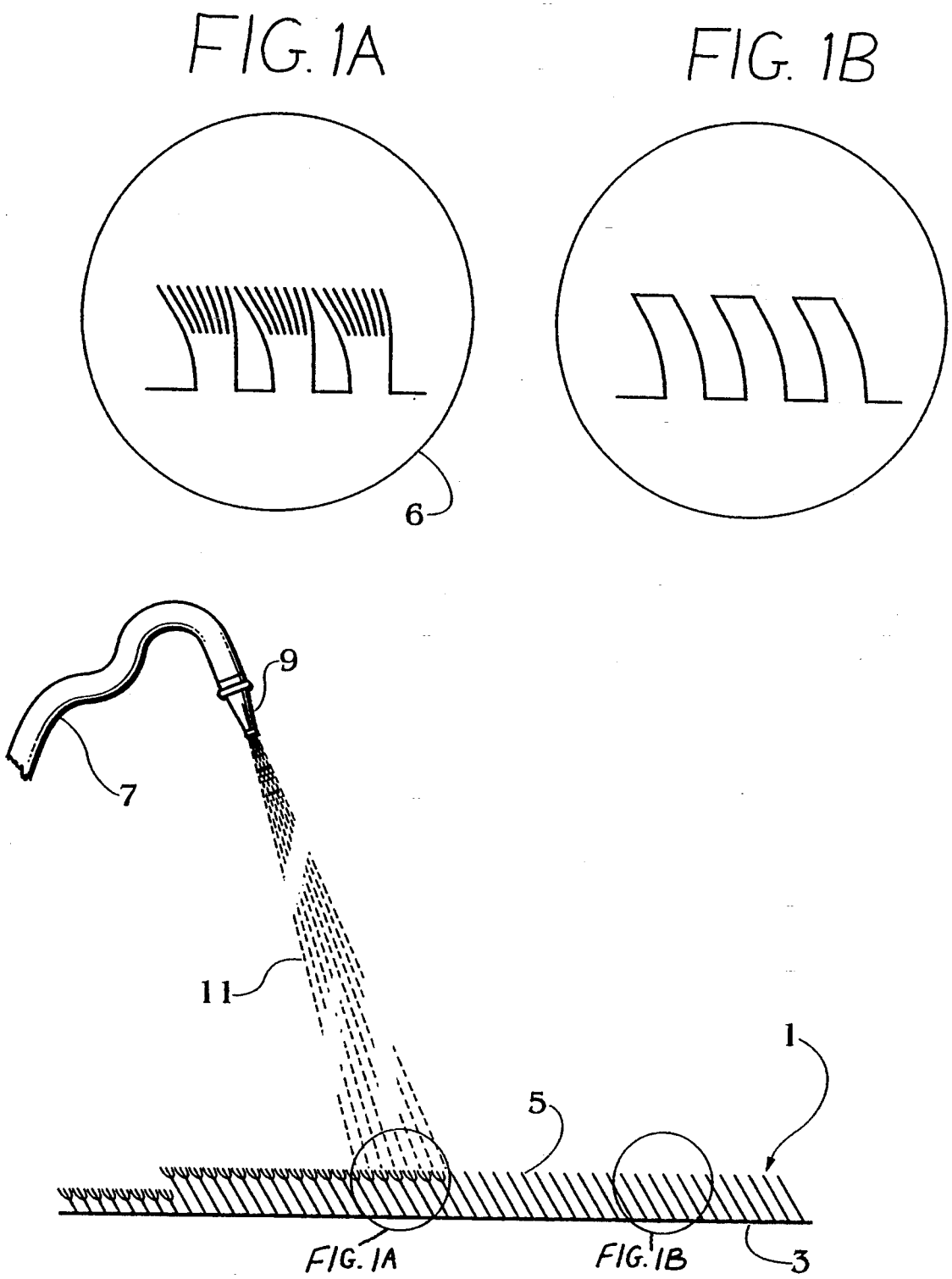
FIGS. 1A and AB are a schematic elevation view of a portion of a synthetic turf surface being subjected to a sandblasting treatment.

Referring to FIG. 1, there is shown a synthetic turf 1. It consists of a base 3 made of a fabric material and from which vertically emerge grass-like blades 5 grouped into tufts fixed by their lower ends solidly to the base by a layer of adhesive material. The latter may be polyurethane or its equivalent. The blades 5 are made of a material selected from the group consisting of polypropylene, nylon and polyester. Also, their length lies in the range from ⅜" and 2", their weight in the range from 28 to 60 ounces per square foot while their denier value is about 5400. The synthetic turf according to the present invention is shown in 6, the blades of the grass-like turf are frayed by means of a sandblast process.

Where the turf is to be used on an artificial golf green, their length is from ⅜" to ¾" and their weight from 60 to 40 ounces per square foot, respectively. If they are to be used on a teeing surface, they have a length of about 2" while their weight is of about 28 ounces per square foot.

Also, a second synthetic turf can be juxtaposed to the turf mentioned above, used for artificial golf green. This second turf comprises a base made of fabric material, a mass of entangled crimped grass-like blades made of a material selected from the group consisting of polypropylene, nylon and polyester. The blades are grouped into tufts projecting upwardly from the base. A layer of adhesive material fixes lower ends of the tufts into the base. The blades have a length in the range of ⅜" and 1", a weight of about 38 ounces per square foot and a denier value of about 5400.

According to the invention, the surfaces of the blades are treated by sandblasting from a sand source in the form of a hose 7 provided at its end with a nozzle 9. The source must be capable of giving a sand pressure of 80 to 120 pounds per square inch. The sand itself should have a screen mesh particle size in the range from 16 to 40. It preferably is a brown or alvine sand having a screen mesh particle size of 24.

In the practice of the method, a person places the nozzle 9 by hand at a distance of about 3 to 4 feet above the turf 1 and the jet 11 is directed against the blades 5 at an angle of about 70° to 80° from the horizontal. The jet is applied by the person with a circular motion, in a direction contrary to that of the blades. Of course, the nozzle can be moved by a machine.

As said above, the method of the invention makes it possible to obtain a turf surface wherein the blades become entangled, crimped and frayed so as to hide the base 3 of fabric material properly and completely, resulting in a dense and uniform playing surface capable of holding a running ball on its trajectory, after being hit, very much as on a natural golf course. The blades also lose their luster and become pale green close to that of natural grass.

Figure 2:
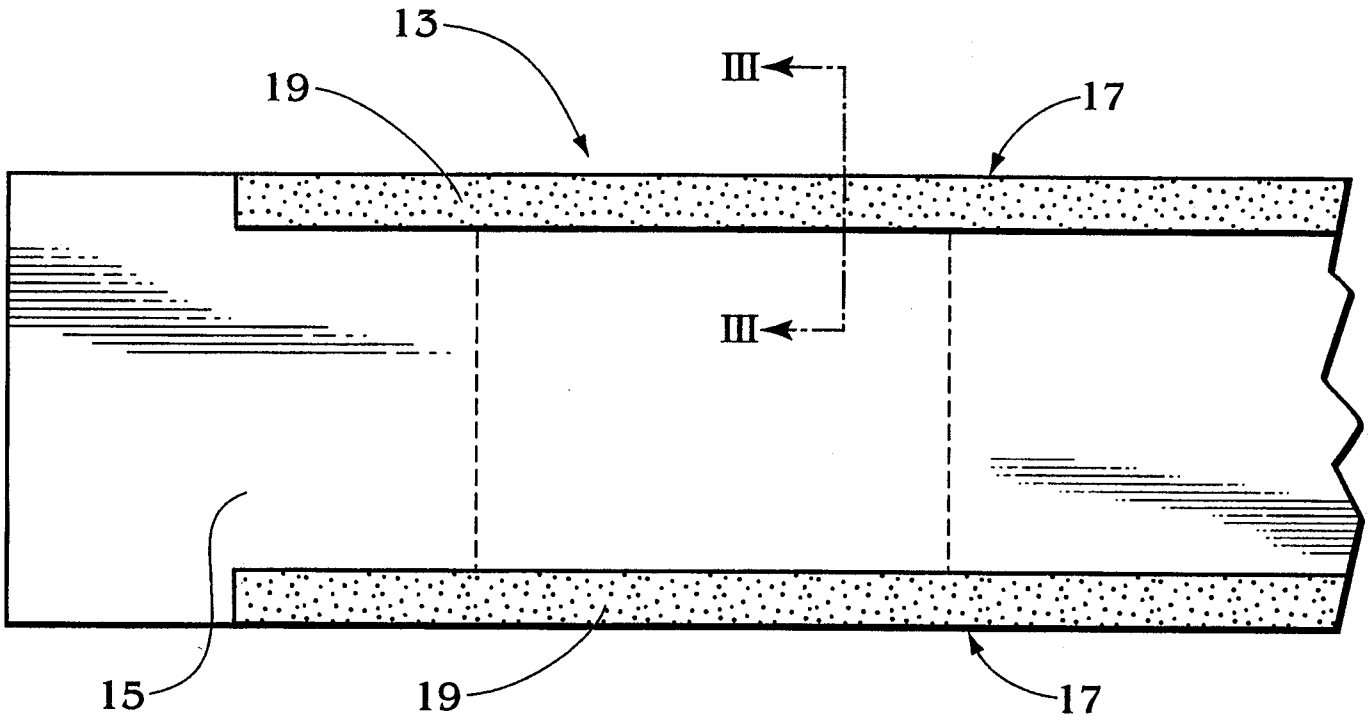
FIG. 2 is a top plan view of a portion of a golf practice course.
Figure 3:
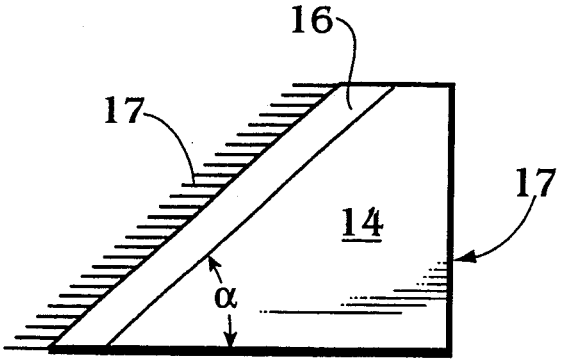
FIG. 3 is a cross-section along line III—III of FIG. 2, showing a border strip according to the present invention.

FIGS. 2 and 3 show another aspect of the invention in the form of an artificial golf practice course 13 having a horizontal planar central playing surface 15 along either edge of which extend the border strips 17 defining, on their faces looking toward the central playing surface, ball rolling surfaces 19 that are inclined at an angle preferably ranging from 30° to 40° or square. The border strip 17 comprises a body 14 made of polystyrene of type 2, a sheet 16 of polypropylene laminated over said body 14 and a synthetic turf, that can be of the type described above, is layed over and made fast with both the playing surface 15 and the rolling surfaces 19. The sheet of polypropylene has a thickness of ½ inch to 1 inch and a density of 2 to 6 pounds per square foot. The grass-like blades have a height preferably of ⅜" to 1" and a weight of 28 ounces per square foot. As to the border strips, their height can be about 8". The inclination of the rolling surface makes it possible to hold the golf ball more accurately on the golf after having been hit by the golf player.

Figure 4:
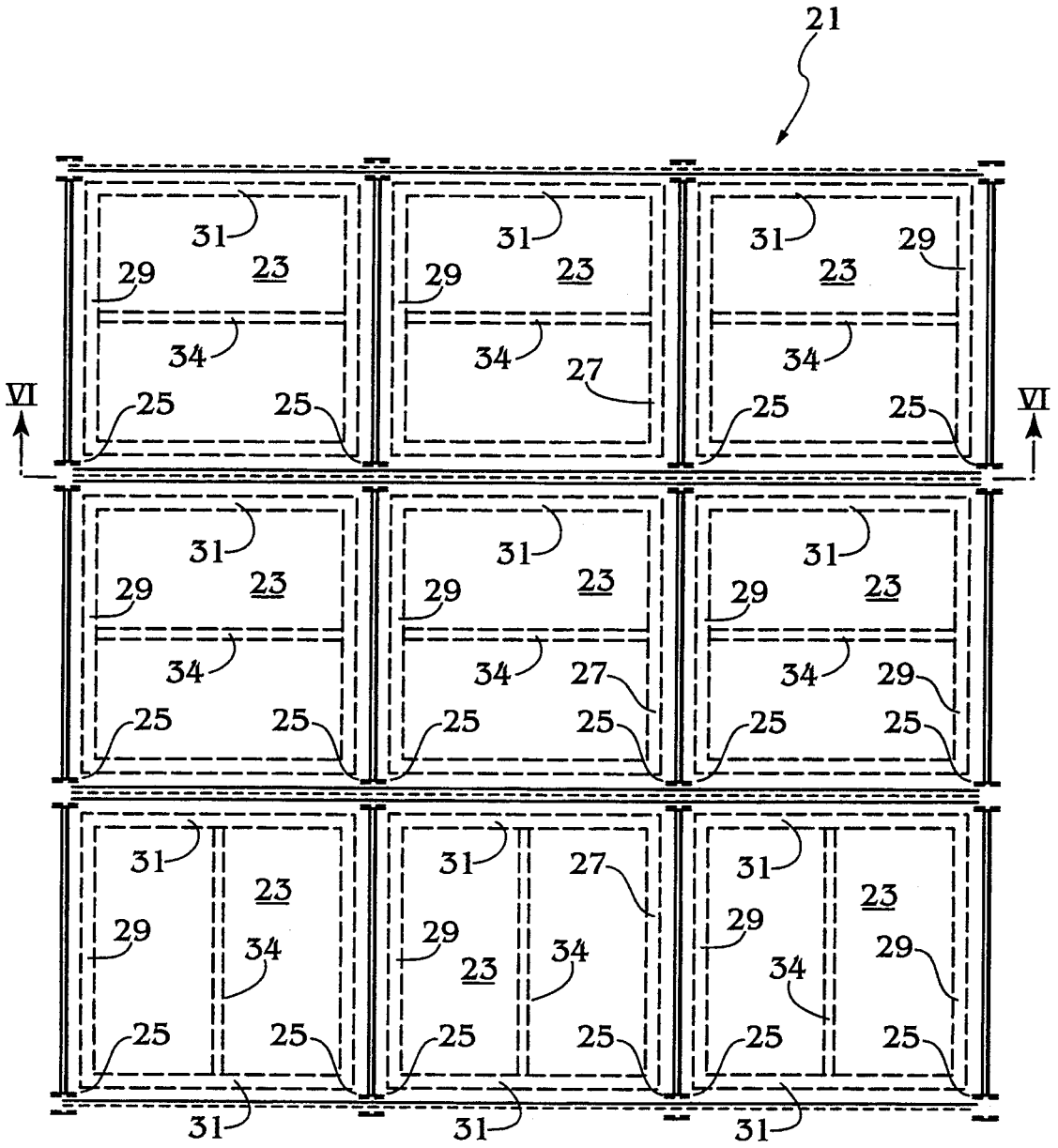
FIG. 4 is a top plan view of a portion of an understructure for an artificial golf course.
Figure 6:
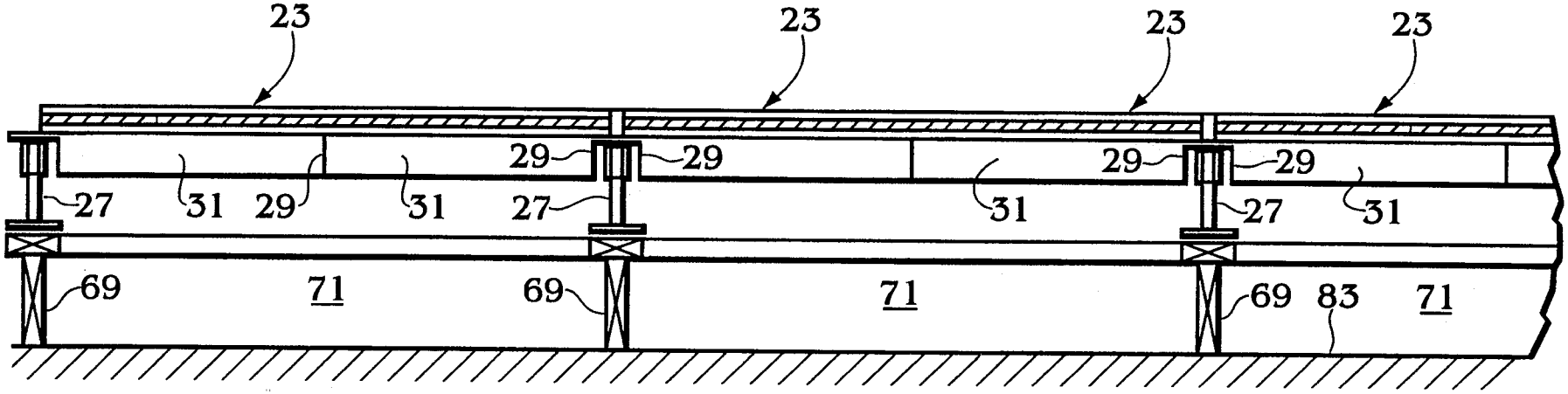
FIG. 6 is a cross-sectional view taken along line VI-VI in FIG. 4.
Figure 8:
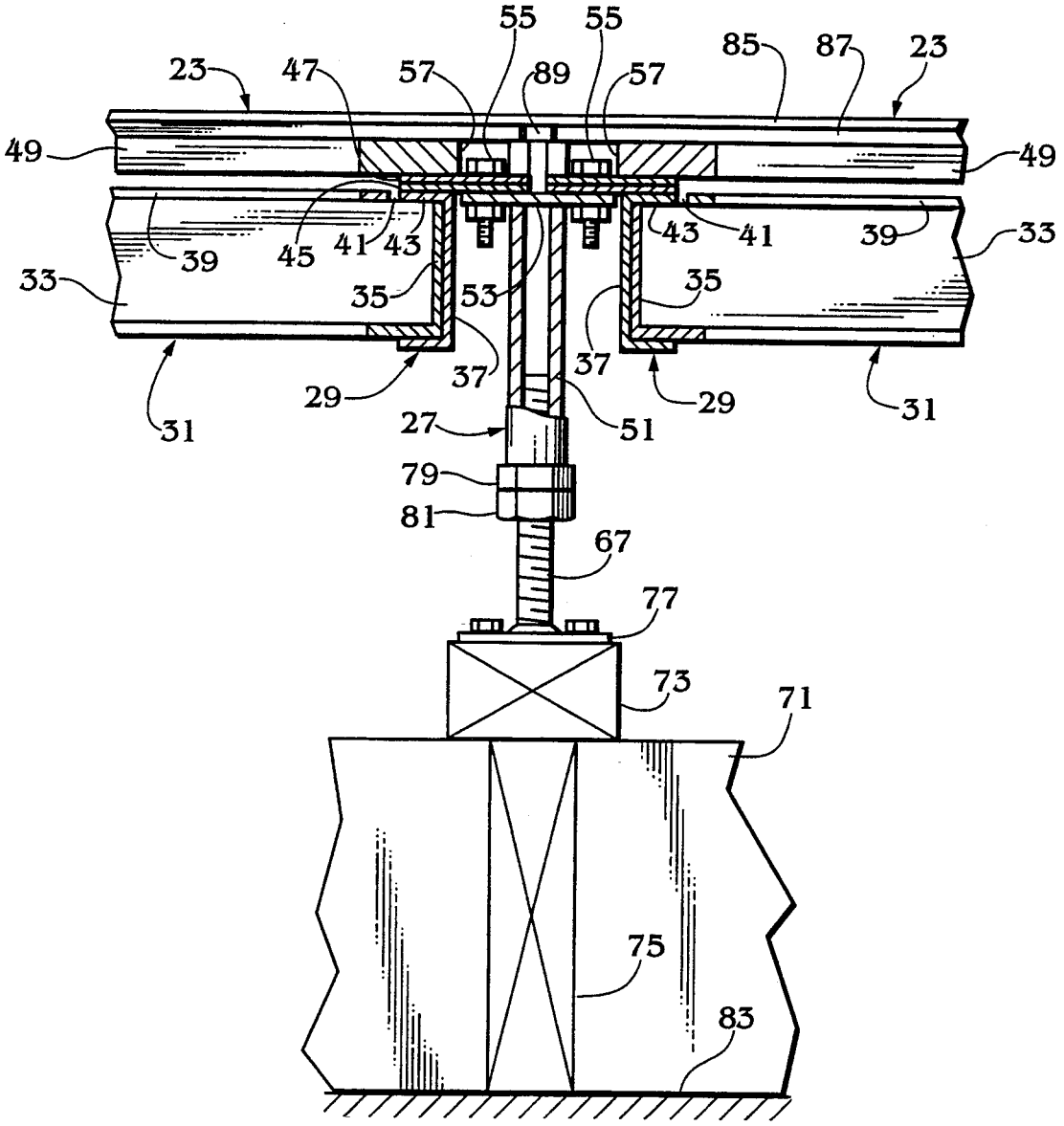
FIG. 8 is a side elevation view, partly broken away to show the inner construction, of the lifting assembly and platform structure, the view being taken at a nodal point of the golf course understructure.

FIG. 4, illustrating only a portion 21 of an understructure for an artificial large size golf course made according to the invention, shows a group of 9 rectangular platform structures 23 of, for example, 8'×8'. Please note that the platforms are not necessarily rectangular. They can be triangular, for example. These structures are arranged side-by-side in the form of a checker-board establishing nodal points 25 at the junctions of every group of four adjoining panel structures. A lifting jack 27, shown in FIGS. 6 and 8, is provided at each nodal point. The corners of adjacent platform structures 23 being connected to the relevant lifting jack.

Each platform structure 23 comprises a rectangular sub-frame made up of longitudinal channel-shaped side members 29 joining, at their ends, with the ends of transverse channel-shaped side members 31 and the manner shown in FIG. 8. The sub-frame should also include central transverse strengthening channel-shaped beams 34 interconnecting the side members 29, and 31.

As illustrated in FIG. 8, the web 33 of one side member 31 is bent inward, at its end, for use as a connecting flange 35 fixed, by self-tapping screws for instance (not shown) to the web 37 of the crossing side member 29. The same applies at each corner connection of two meeting members 29 and 31. The ends of the upper flanges 39 of the side members 31 are cut off at 41 to allow for the insertion of the members 31 into the members 29 and thus allow the flanges 39 to be made level with the upper flanges 43 of the side members 29. Secured to the side members 29 and 31 at their junctions, as by self-tapping screws (not shown), are L-shaped bottom corner anchor plates 45 shown in FIG. 11 and top corner anchor plates 47 shown in FIG. 10. It will be noted from FIGS. 10 and 11, that the plates 45 and 47 are cut out of rectangular plates of equal size, therefore having side edges of equal length overlapping one another in the situation of FIG. 8. Also, the combined plates 45 and 47 largely overlap the frame members 29 and 31.

Finally, each platform structure 23 further comprises a plywood floor panel 49, which can be made of any other flexible material such as fiber glass, fixed to the anchor plates 45 and 47, as well as to the upper flanges 39 and 43, of the frame members 31 and 29, by any known means such as by self-tapping screws. In this manner, it will be understood that the sub-frames 29 and 31, the anchor plates 45 and 47, and the plywood floor panel 49 form a solid body. It should be noted that the side edges of the floor panel fall in line with the corresponding side edges of the plates 45 and 47, as best seen in FIG. 8.

Figure 9:
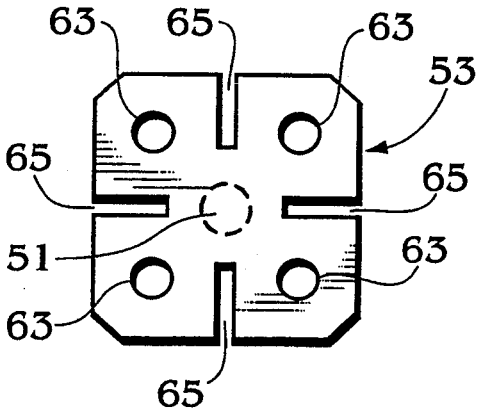
FIG. 9 is a top plan view of a lifting jack plate.
Figure 5:
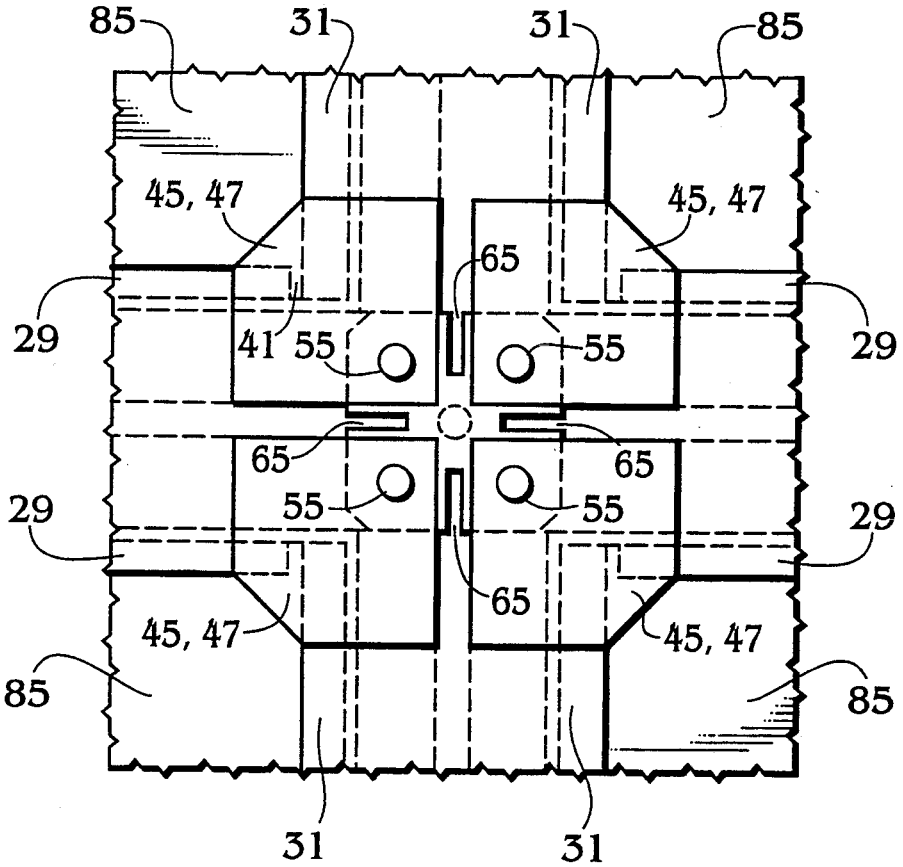
FIG. 5 is a top plan view, on an enlarged scale, taken at a nodal point in the plan view of FIG. 4.
Figure 11:
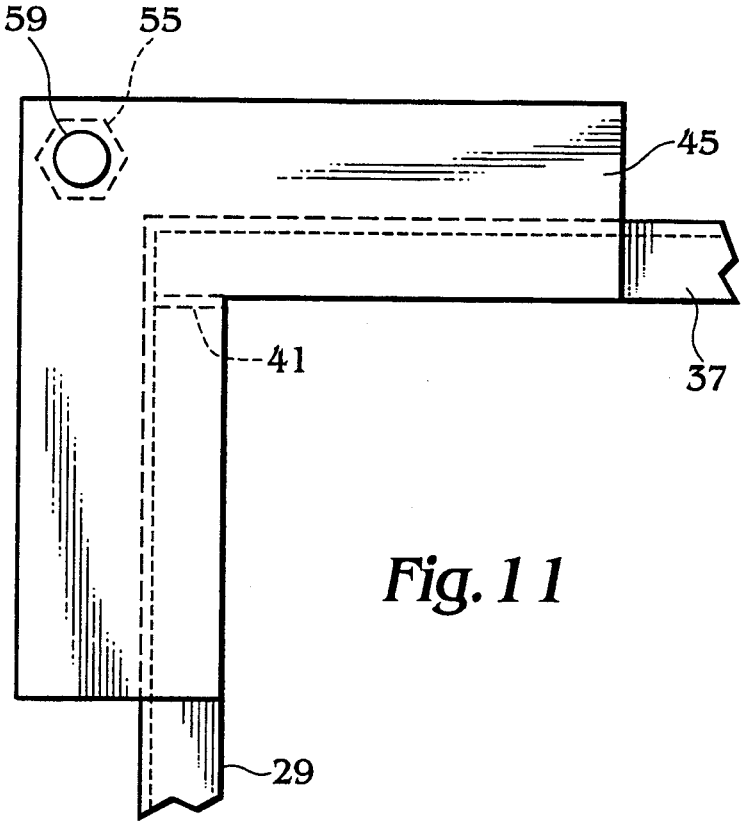
FIGS. 10 and 11 are plan views of anchor plates located at the corners of a surface panel of one platform structure of the understructure.
Figure 10:
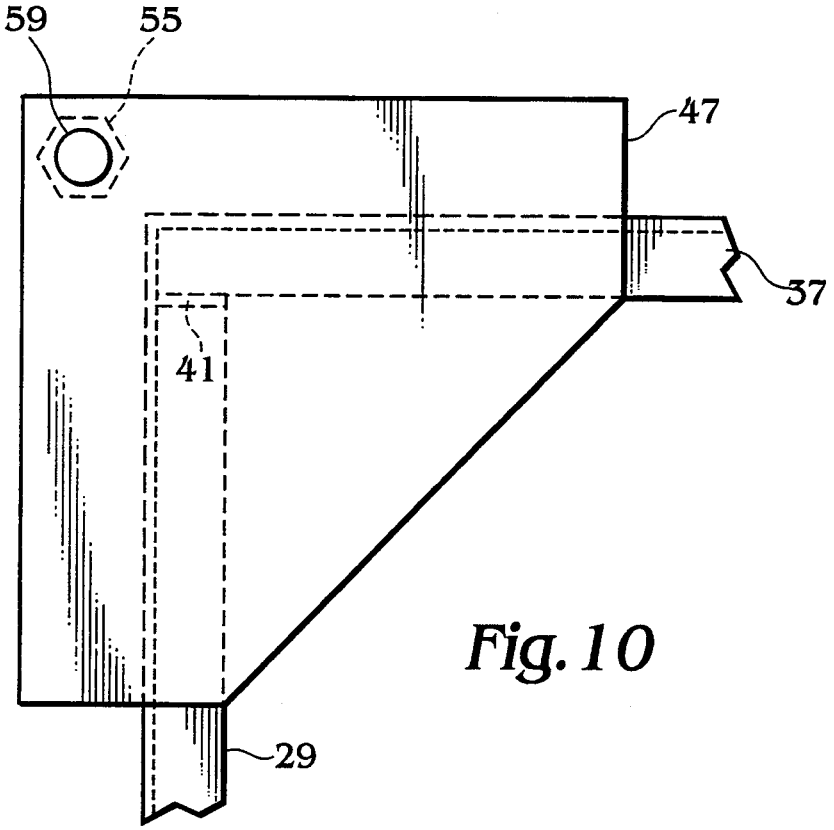

In this FIG. 8, it is seen that each lifting jack 27 is made up of a lifting rod in the form of a hollow cylindrical pipe 51 having, fixed transversely at its upper end, a rectangular jack plate 53, also shown in FIGS. 5 and 9. Every platform structure 23, around a nodal point 25, is secured to the corresponding jack plate 53, at one corner by a single bolt and nut combination 55 of which the bolt extends successively through an appropriate hole 57 of the floor panels 49, hole 59 of the anchor plate 47, hole 61 of the second anchor plate 45, and finally hole 63 in the jack plate 53, as shown in FIGS. 9, 10 and 11.

Referring now to FIG. 8, it is seen that the floor panels 49 and the anchor plates 45 and 47, overhang the side members 29 and 31 sufficiently to allow them to avoid the jack plate 53.

As shown, the anchor plate 45 is formed with a through torsion slot 65 between each two successive bolt holes 63, in alignment two-by- two and opening on an edge of the plate.

Figure 7:
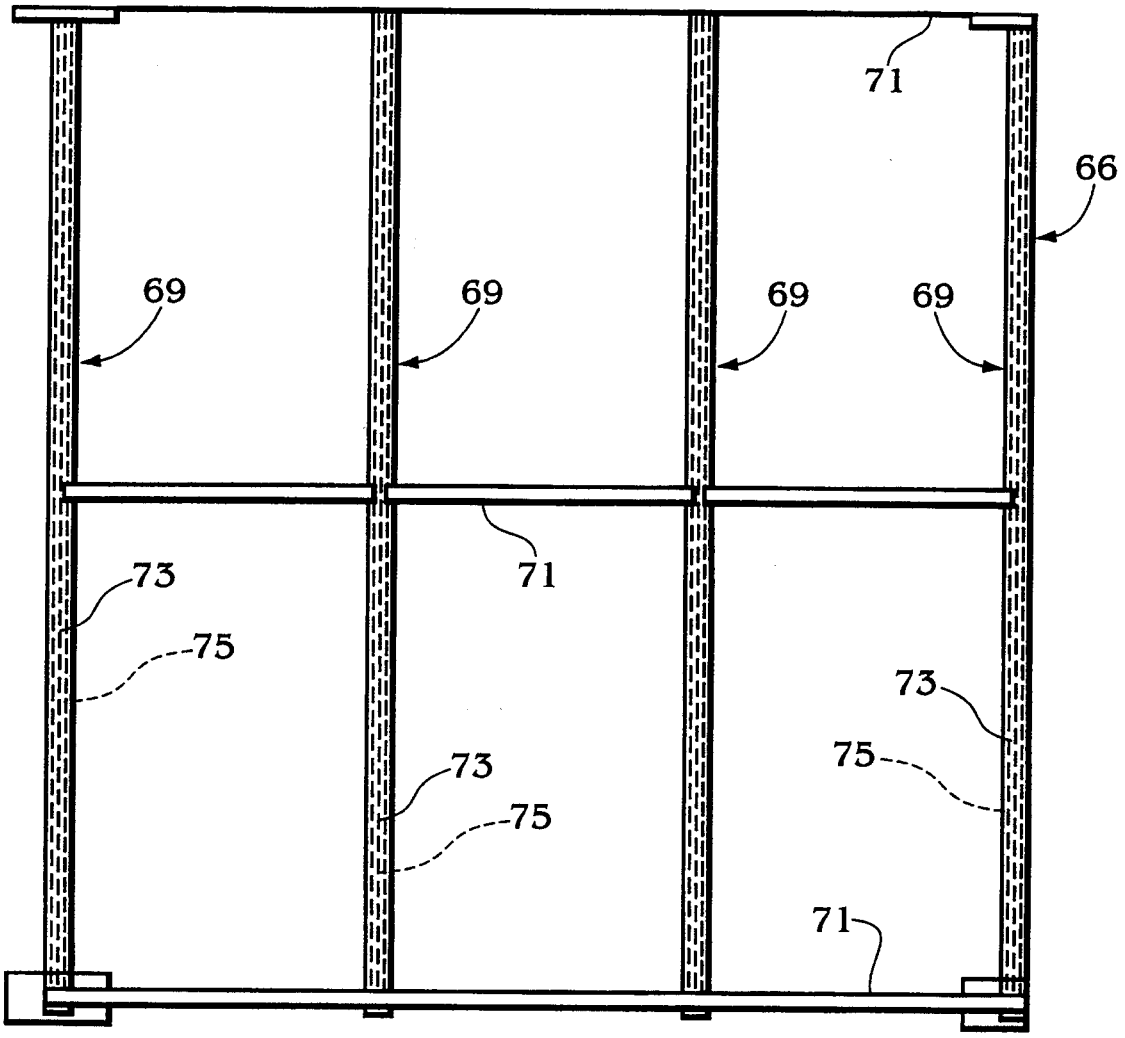
FIG. 7 is a top plan view of a portion of the wooden understructure supporting the lifting jacks.

Each jack 27 further comprises a power screw 67 of which the upper end is slid into the relevant jack pipe 51 while its lower end is secured to a wooden supporting understructure 66 shown in FIG. 7. The latter is formed of a series of parallel longitudinal T-shaped beams 69 interconnected by cross-beams 71. Each beam 69 has a top rectangular element 73 lying flat on an edgewise rectangular vertical element 75 to which it is nailed. The jack seating plate 77 is fixed, as by screws, to the top element 73. Finally, adjustment of the height of the jack pipe 51 is obtained by power nut 79. A lock nut 81 serves to hold the jack 27 at a selected height. As to the wooden understructure 67, it is made to rest on level ground 83 which is preferably obtained with compacted sand.

As shown in FIG. 8, the top face of each floor panel 49 is covered with a turf carpet 85, which may be of the type described above, glued to a cushioning underlayer 87 of polypropylene, itself secured to the floor panel 49. A narrow polypropylene strip 89 is made to fill the space between two adjacent underlayers 87.

Once the wooden understructure 67 has been set firm and level on the ground 83, the jacks 27 are fixed to it and operated to lift the platform structures 23 at different preselected heights for them to define an undulated golf course forming mounds and depressions. The use of a single bolt connection 55 joining one corner of a platform structure 23 to a corner of a jack plate 53, along with the provision of the slots 65 through the same plate are intended to relieve the pressure created by the lifting jacks 27 for providing the different nodal heights.

Although the present invention has been explained hereinabove by way of a preferred embodiment thereof, it should be pointed out that any modifications to this preferred embodiment, within the scope of the appended claims is not deemed to change or alter the nature and scope of the present invention.

What is claimed is:

1. A synthetic turf comprising:

a base made of fabric material;

a plurality of grass-like blades made of a material selected from the group consisting of polypropylene, nylon and polyester projecting upwardly from said base, each of said blades having a lower portion, a middle portion, and a frayed upper portion;

said frayed upper portion comprising a tuft of strand elements integral with the corresponding lower and middle portions;

a layer of adhesive material for attaching said lower ends of said blades to said base, each of said blades having a length in the range of ⅜" to 2" and a weight in the range of 28 to 60 ounces per square foot;

said frayed upper portions of said grass-like blades being entangled and crimped to completely hide said base and provide a dense and uniform playing surface.

2. A synthetic turf as claimed in claim 1, for use on artificial golf greens, wherein said blades have a length of ⅜" to ⅜", a weight from 60 to 40 ounces per square foot, respectively and a denier value of about 5400.

3. A synthetic turf as claimed in claim 2, juxtaposed with a second synthetic turf comprising:

a base made of fabric material;

a plurality of grass-like blades made of a material selected from the group consisting of polypropylene, nylon and polyester, each of the blades of said second turf projecting upwardly from the base of said second synthetic turf, each of said blades having a lower portion, a middle portion, and a frayed upper portion;

said frayed upper portion comprising a tuft of strand elements integral with the corresponding lower and middle portions; and a layer of adhesive material fixing said lower ends of the blades of said second turf into their corresponding base, the blades of said second turf having a length in the range of ⅜" and 1", a weight of about 38 ounces per square foot and a denier value of about 5,400.

4. A synthetic turf as claimed in claim 1, for use on a teeing surface, wherein said blades have a length of about 2", a weight of about 28 ounces per square foot and a denier value of about 5400.

5. A synthetic turf as claimed in claim 1, juxtaposed with a second synthetic turf comprising:

a base made of fabric material;

a plurality of grass-like blades made of a material selected from the group consisting of polypropylene, nylon and polyester, each of the blades of said second turf projecting upwardly from the base of said second synthetic turf, each of said blades having a lower portion, a middle portion and a frayed upper portion;

said frayed upper portion comprising a tuft of strand elements integral with the corresponding lower and middle portions; and a layer of adhesive material fixing said lower ends of the blades of said second turf into their corresponding base, the blades of said second turf having a length in the range of ⅜" and 1", a weight of about 38 ounces per square foot and a denier value of about 5400.

* * * * *